United States Patent [19]

Murray et al.

[11] 4,223,049

[45] Sep. 16, 1980

[54] SUPERFICIALLY MIXED METAL OXIDE ELECTRODES

[75] Inventors: Royce W. Murray, Chapel Hill, N.C.; P. R. Moses, Windham, N.H.; Larry Wier, Schenectady, N.Y.

[73] Assignee: Research Triangle Institute, Research Triangle Park, N.C.

[21] Appl. No.: 908,624

[22] Filed: May 23, 1978

[51] Int. Cl.[2] ..... B05D 5/12; C25B 11/00; C25C 7/02

[52] U.S. Cl. ..... 427/126; 427/353; 204/290 F

[58] Field of Search ..... 204/290 F; 427/125, 427/126, 353, 115

[56] References Cited

U.S. PATENT DOCUMENTS

| | | | |
|---|---|---|---|
| 433,074 | 7/1890 | Drautz | 427/354 |
| 815,664 | 3/1906 | Wickel | 427/354 |
| 3,801,351 | 4/1974 | Dauksys | 427/354 |
| 3,882,002 | 5/1975 | Cook, Jr. | 204/290 F |

*Primary Examiner*—John D. Smith
*Assistant Examiner*—Richard Bueker
*Attorney, Agent, or Firm*—Cushman, Darby & Cushman

[57] ABSTRACT

A superficially mixed metal oxide electrode and a method of preparing same. The electrode is useful in anodic electrochemical reactions. There is no distinct outer layer of either noble metal or noble metal oxide. Instead, the noble metal or noble metal oxide is superficially mixed in with a layer of an oxide of a film-forming metal which has been deposited over a conductive base metal.

12 Claims, No Drawings

SUPERFICIALLY MIXED METAL OXIDE ELECTRODES

The Government has rights in this invention pursuant to Grant No. DMR 72-03024 awarded by the National Science Foundation.

BACKGROUND OF THE INVENTION

The present invention relates to a novel superficially mixed metal oxide electrode and the process by which it is made. The electrode is useful in anodic electrochemical reactions, particularly the anodic electrochemical oxidation of chloride to chlorine in an aqueous solution.

A variety of materials have been utilized in chlorine anodes starting with graphite. But because of several problems inherent to graphite, most notably its high overpotential and relatively low corrosion resistance, catalytically active noble metals and noble metal oxides were used. While successfully overcoming the disadvantages of graphite, such electrodes are extremely expensive.

Various attempts have been made to reduce or replace the noble metals in chlorine anodes. The use of a conductive tin oxide layer consisting only of mixtures of tin oxide and antimony is disclosed in U.S. Pat. No. 3,627,669, but a conductive tin oxide layer exhibits extremely high overpotential for chloride oxidation. One method recently developed to utilize decreased amounts of noble metal is that illustrated in U.S. Pat. No. 3,711,385. This is, essentially, coating the valve metal substrate with a thin film or coating of a noble metal or noble oxide which is preferably a mixture of platinum with another noble metal or noble oxide. The difficulties experienced with these electrodes are discussed in U.S. Pat. No. 3,882,002 to Cook and it is because of those difficulties that Cook developed his electrode as described in the patents listed below.

Typically, as shown in a review of U.S. Pat. Nos. to Cook, 3,882,002, 3,951,766, 3,986,942, 3,940,323, 3,943,024 and 3,956,083, electrodes to be used in electrolytic processes are comprised of a valve metal substrate, normally titanium, coated with conductive tin oxide and which have an outer coating of a noble metal or noble metal oxide. Such an electrode is normally prepared by depositing an adhering layer of tin oxide on the titanium base. Preferably, a minor amount of dopant, for example, an antimony compound is also codeposited along with the tin oxide forming a conductive tin oxide. The antimony stabilizes and lowers the electrical resistivity of tin oxide compositions. The tin oxide along with the dopant may be adherently formed on the titanium base in a number of ways. For example, the titanium base can be sprayed, painted, brushed or otherwise coated with an aqueous solution of a thermally decomposable salt containing, for example, a salt of tin and a salt of a suitable dopant such as antimony. The coating is then dried by heating, for example at about 100° to 200° C., for a few minutes to evaporate the solvent and then at higher temperatures, e.g., 250° to 800° C. in an oxidizing environment to convert the tin and antimony to their respective oxides.

Optionally, small amounts of a chlorine discharge catalyst such as manganese difluoride may also be added to this tin oxide layer to lower the overpotential required for chlorine gas liberation.

The electrodes prepared in accordance with the above-listed Cook patents have an outer layer consisting of either a noble metal or noble metal oxide. This outer layer is deposited over the conductive tin oxide layer by such known methods as electroplating, chemical deposition from a platinum coating solution, or spraying. A noble metal oxide outer layer can be made by depositing the noble metal in the metal state followed by oxidation, for example, by galvanic or chemical means or by heating at elevated temperatures of from about 300° to 600° C. or higher in an oxidizing atmosphere. A preferred method for the formation of the noble metal oxide layer involves coating the conductive tin oxide layer with a solution of a noble metal compound, evaporating the solvent, and then oxidizing the noble metal at elevated temperatures between about 300° and about 800° C. in an oxidizing atmosphere.

electrodes prepared by this known method, while demonstrating good overpotential properties in, for example, the anodic electrochemical oxidation of chloride in an aqueous medium to chlorine, still use a substantial amount of noble metal in making the necessary outermost layer.

It is, therefore, an object of this present invention to make an electrode with good overpotential properties, but which contains only a minimal amount of noble metal.

It has been discovered that a superficially mixed metal oxide electrode can be prepared in accordance with the present invention which has significantly less noble metal present while, surprisingly, retaining favorable overpotential properties necessary for chlorine oxidation.

For purposes of the present invention, a valve metal and a film-forming metal are essentially the same and mean one of the metals, titanium, zirconium, niobium, tantalum, and tungsten or an alloy consisting mainly of these elements and having anodic polarization properties similar to the commercially pure elements as known in the art. For electrodes used in the anodic electrochemical oxidation of chloride to chlorine in an aqueous solution, the preferred film-forming metals are titanium and alloys which are based on titanium and have anodic polarization properties comparable to those of titanium.

DESCRIPTION OF THE INVENTION

The present invention is directed towards a process for making these superficially mixed metal oxide electrodes. The valve metal substrate is preferably a conductive base metal such as titanium, tantalum, niobium or zirconium, preferably titanium, which is coated with an oxide of a film-forming metal such as titanium oxide, or with conductive tin oxide or a mixture thereof. This coating can be prepared in several ways, such as electrolytic anodization of Ti to form a coating of titanium oxide, chemical vapor deposition of titanium oxide by impinging a vapor stream of a volatile, reactive titanium compound and water vapor onto the surface of heated Ti, or by brushing or spraying a solution of a tin or titanium compound, or a mixture thereof, dissolved in a volatile solvent onto heated Ti. The application is followed by heating of the film coating of tin and/or titanium compounds at typically 450° C. for 0.5 hours, to convert it to the oxide form. The application may be repeated several times to build up a sufficiently thick layer to completely cover the underlying Ti metal base. The desirable qualities of this coating are durable adhesion to the metal base and high specific surface area. Cleaning of the Ti base, its temperature during spray or vapor coating, and the rate of application of the coating are important variables in producing the best coatings. The procedures for preparing oxide coating of film-forming metals such as titanium or of a conductive tin oxide or a mixture thereof on a metal base such as Ti are known and are discussed in the Cook patents listed above.

The overpotential required for the liberation of chlorine gas in electrolysis at an electrode made in accordance with the present invention may be reduced as discussed above by incorporating a small amount of chlorine discharge catalyst in the conductive tin oxide or titanium oxide layer. Such discharge catalysts are normally one or more of the difluorides of manganese, iron, cobalt and nickel with manganese being preferred.

The dopants, for example, antimony, and the chlorine discharge catalysts may be incorporated into this tin oxide layer by the known methods such as those disclosed in U.S. Pat. No. 3,882,002.

According to the present invention, the metal oxide electrode is then immersed in an aqueous solution of a coordinatively reactive salt of a metal which has the property of forming an electrically conducting oxide, such as ruthenium, iridium, rhodium, or platinum. A typical salt would be $RuCl_3$, $IrCl_3$, $PtCl_4$, or $RhCl_3$, in 0.02 M concentration. The solutions during this procedure remain as true solutions, that is, no visible precipitation occurs either before or after immersion of the metal oxide electrode. The metal oxide electrode is removed from the solution and all adhering solution thoroughly washed from its surface using distilled water. The noble metal salt in the wash solution can be recovered and reconcentrated for re-use. The metal oxide electrode next is heated for a period of, for example, about 0.5 hours at about 450° C.

The electrode which is produced in accordance with the present invention is unique in that there is no undiluted outer layer of noble metal or oxide of a noble metal as is present in an electrode made according to the method disclosed in the Cook patents. Instead, the noble metal has penetrated the metal oxide layer so as to produce an electrode which has a mixed oxide surface of restricted thickness with no outer layer of noble metal or oxide of noble metal. Thus, the usage of noble metal is significantly reduced. It is estimated that, depending on the texture and composition of the valve metal oxide layer, the penetration by the noble metal in the case of ruthenium corresponds from about $10^{-3}$ to about $10^{-1}$ g/m$^2$. The range of noble metal usage cited in the Cook U.S. Pat. No. 3,888,002 is 0.1–20 g/m$^2$ with 3–10 g/m$^2$ preferred.

The difference between the outermost layer of an electrode prepared according to the disclosure of the Cook U.S. Pat. No. 3,882,002 and an electrode made in accordance with the present invention can be demonstrated through use of X-ray photoelectron spectra (XPES), which can detect photoelectrons from such metals as ruthenium, titanium and tin.

The important aspect of XPES is that it responds to elements located only within the outermost few tens of Angstroms of surface. Typically, the response of a metallic element is attenuated by about one-third for each 15 Angstroms of over-laying metal or metal oxide. If a metal oxide, e.g., $RuO_2$, is present as a layer of about 2 to 3 times greater thickness than this over all the exposed surface, then the metal oxide on which it is layered, e.g., the $SnO_2$ or $TiO_2$, will exhibit little or no photoelectron band in the XPES spectrum of the material. Only the XPES band for Ru (and of course oxygen) would be seen in this case. On the other hand, if a superficially mixed oxide surface is formed, XPES bands for both Ru and the other metal will be seen, in approximately an intensity ratio determined by the relative proportions of the two metals in about the outermost 15–30 Angstroms.

Three different electrodes were made. Electrode 1 was prepared in accordance with the disclosure in the Cook U.S. Pat. No. 3,882,002 by spraying a solution of $SnCl_4.5H_2O$ in n-butanol onto a titanium base and baking to prepare a $SnO_2$ layer, and then spraying on a solution of $RuCl_3$ in n-butanol, air drying the electrode without rinsing and then oven baking. Electrode 2 was prepared in accordance with the present invention by spraying a solution of $SnCl_4.5H_2O$ in n-butanol onto a titanium base and baking to prepare a $SnO_2$ layer, and was then briefly (ca. 1 minute) immersed in a $RuCl_3$ solution followed by thorough rinsing and oven baking. Electrode 3 was prepared the same as electrode 2 except that the valve metal oxide applied during the spray step was $TiO_2$ instead of $SnO_2$. For all three electodes a small percentage of antimony and manganese salt was added as dopant and as chlorine discharge catalyst in the spray solution to improve electrode properties.

The X-ray photoelectron spectra for electrode 1 showed only ruthenium. There was no tin photoelectron band. Thus, electrode 1 is a layered electrode with an essentially pure ruthenium oxide outermost layer just as disclosed in the Cook U.S. Pat. No. 3,882,002.

The X-ray photoelectron spectra for electrodes 2 and 3 also showed a ruthenium band but concurrent therewith was a strong tin band for electrode 2 and a strong titanium band for electrode 3. The tin and titanium bands were little changed (10–30%) from their intensities prior to the $RuCl_3$ treatment, so the surface is only slightly depleted in those elements. The outermost layer of electrodes 2 and 3 are thus demonstrated to be true superficially mixed metal oxide surfaces. The ruthenium oxide has been chemisorbed on the valve metal oxide substrate, e.g., $SnO_2$ or $TiO_2$ and additionally (as more explicitly shown below) penetrates the substrate for a short distance. Electrodes 2 and 3 which were prepared in accordance with the present invention do not result in a $RuO_2$ outermost layer as did electrode 1 prepared in accordance with the known method.

The approximate atom ratios of ruthenium to tin and titanium at the surfaces of electrodes 2 and 3 is 0.03 and 0.04, respectively. These ratios were determined by using photoelectron cross-section values.

The coordinatively reactive metal salts used, for example, $RuCl_3$ or $IrCl_3$, have the general property of strongly adhering to, or more properly, chemisorbing on, the valve metal oxide electrode surfaces. This chemisorbed layer is not removed by washing, by the heat treatment, or by use in electrolysis, and also gives the electrode much improved electrical conductivity properties. It is believed that it is the presence of the chemisorbed layer which is responsible for the favorable electrolysis properties of the superficially mixed oxide electrodes.

Research has demonstrated that immersion of electrodes which consist of thin (transparent) films of highly (fluoride) doped tin oxide coated on glass backing, prepared commercially by PPG Industries and hereafter referred to as PPG tin oxide, in aqueous $RuCl_3$ solutions results in strong chemisorption of ruthenium of the tin oxide. Furthermore, in X-ray photoelectron experiments in which the electrode surface is gradually sputtered away with an $Ar^+$ ion beam, the Ru spectral band persists for an approximately 10–15 minute perriod. The X-ray photoelectron experiment is sensitive only to chemicals present in the outmost approximately 15 Angstroms ($1.5\times10^{-7}$ cm) of the sample, and so the sputtering experiment indicates, along with an estimate of the sputtering rate, that the Ru penetrates into the tin oxide lattice for some 50 Angstroms or more. The experiments showed that ruthenium not only strongly chemisorbs on the surface of tin oxide, but it also penetrates or is imbibed by the tin oxide lattice for a certain distance. An analogous experimental result was obtained for exposure of a single crystal of titanium oxide, $TiO_2$, to $RuCl_3$ solution; this material also imbibes ruthenium. This suggests that this distance corresponds to a region of non-stoichiometry, or disordered lattice, on the outermost parts of the tin or titanium oxides, and that the ruthenium most easily penetrates this non-rigid coordinatively reactive region. Factors in the treatment of the tin or titanium oxide electrode which expand or contract this lattice non-stoichiometry layer would preferably also affect the quantity of imbibed ruthenium, for example, or other metal. It is believed that the phenomenon of chemisorption of more than a monolayer of ruthenium by the tin oxide is at least in part responsible for electrodes prepared in accordance with the present invention exhibiting a stable, ruthenium oxide-like electrolysis character.

Electrodes 2 and 3 were then subjected to a series of immersions in $RuCl_3$ solution followed by washing with distilled water and then oven baking. Even after ten of such sequential treatments, the XPES showed no undiluted $RuO_2$ outermost layer and continued to show, essentially unchanged, the tin and titanium photoelectron peaks. The electrodes still had only a superficially mixed oxide outer surface, although a slight darkening did indicate additional up-take of ruthenium was occurring.

The repeated immersions in $RuCl_3$ followed by washings with distilled water and oven baking, unexpectedly, did produce a marked improvement in the chloride oxidation properties of the electrode. The oxidation current observed at +1.75 volt versus a S.C.E. reference (potential) electrode was increased by more than 10 times after only two such sequential treatments. The oxidation current was increased by an additional 10 times after eight additional sequential treatments with $RuCl_3$. It is estimated that the (ten times) multiple-treated electrodes could contain about 0.2 gram/$m^2$ of ruthenium.

The chloride oxidation properties of a number of different electrodes including electrodes prepared by the known method and electrodes prepared in accordance with the present invention were compared as in the following specific examples.

In the first comparison electrodes were prepared and used for oxidation of aqueous 1 M NaCl at ambient room temperature in an electrolysis cell with unseparated compartments, the metal oxide electrode as anode, a platinum wire cathode, and a saturated calomel electrode (S.C.E.) as potential reference electrode. Electrode A is a titanium base, spray coated with a n-butanol solution of $SnCl_4 .5H_2O$ and Ti(iso-propoxide)$_4$ and baked at 450° C. for 0.5 hour. Electrode B is prepared similarly, and then immersed once in a freshly prepared aqueous 0.02 M $RhCl_3$ solution for a few minutes, removed and thoroughly washed with distilled water, and baked at 450° C. for 0.5 hour. Electrode C is prepared as Electrode A, and then immersed (once) in a freshly prepared aqueous 0.02 M $RuCl_3$ solution for a few minutes, removed and thoroughly washed with distilled water, and baked at 450° C. for 0.5 hour. Electrode D is a titanium base spray coated with a n-butanol solution of $RuCl_3$ and baked at 450° C. for 0.5 hour. Electrode E is a titanium base spray coated with a n-butanol solution of $IrCl_3$ and based at 450° C. for 0.5 hour. Electrodes D and E are titanium base electrodes with outermost $RuO_x$ and $IrO_x$ layers, respectively, which are known to have highly favorable (low) overpotential properties for the oxidation of chloride to chlorine.

A linear potential sweep (50 mv./sec.) was applied to Electrodes A–E. The oxidation current at each rose sharply in a range of positive potential characteristics of the particular electrode. The oxidation overpotentials for each electrode for attainment of an anodic current density of 1.0 ma./$cm^2$ are given in Table I. Electrodes D and E exhibited the lowest overpotentials during the chlorine production. Electrode A exhibited a very high overpotential and is poorly suitable for the chloride oxidation reaction. Electrodes B and C, examples of the present invention, have a considerable lower overpotential than Electrode A with Electrode C having a lower overpotential than Electrode B.

TABLE I

| Electrode | Spray Solution[a] | Soaking Treatment | E vs S.C.E. to achieve 1.0 ma./$cm^2$ |
|---|---|---|---|
| A | 75% $SnCl_4$, 25% Ti(i-pro)$_4$ | | 2.25 |
| B | 50% $SnCl_4$, 50% Ti(i-pro)$_4$ | $RhCl_3$ solution | 1.667 |
| C | 85% $SnCl_4$, 15% Ti(i-pro)$_4$ | $RuCl_3$ solution | 1.27 |
| D | $RuCl_3$ | | 1.12 |
| E | $IrCl_3$ | | 1.15 |

[a]% are the relative proportions of $SnO_2$ and $TiO_2$ expected from the relative concentrations of $SnCl_4$ and Ti(iso-propoxide)$_4$ used in the n-butanol spray solution.

A second comparison was conducted for oxidation of 1 M NaCl at ambient temperature in the same non-divided cell as above. Electrodes F, G and H are prepared in the same manner as Electrode A. Electrodes G and H are then briefly immersed in aqueous 0.02 M $IrCl_3$ and $RuCl_3$ solutions, respectively, thoroughly washed with distilled water, and baked at 450° C. for 0.5 hour. Electrodes I and J are prepared in the same manner as Electrodes D and E, respectively. An anodic current of 1.0 ma./$cm^2$ is applied to each electrode in the stirred 1 M NaCl solution and its potential monitored. For each electrode, the potential momentarily rose and then stabilized. Values of the potential after 5 minutes are given in Table II. As in Table I, Electrodes G and H are those prepared according to the present invention, while Electrodes I and J are those prepared by known methods.

TABLE II

| Electrode | Spray Solution | Soaking Treatment | E after 5 min. for applied current 1.0 ma./$cm^2$ |
|---|---|---|---|
| F | 50% Ti(i-pro)$_4$ + 50% $SnCl_4$ | | 1.815 |
| G | 50% Ti(i-pro)$_4$ + 50% $SnCl_4$ | $IrCl_3$ | 1.402 |
| H | 50% Ti(i-pro)$_4$ + 50% $SnCl_4$ | $RuCl_3$ | 1.382 |
| I | $RuCl_3$ | | 1.120 |
| J | $IrCl_3$ | | 1.090 |

A third comparison used a series of electrodes as anodes for chloride oxidation in an undivided cell containing in the anode compartment 1 M HCl and 4 M NaCl saturated with chlorine gas and maintained at ca. 80° C. A Pt electrode was used as cathode. The anode potential relative to S.C.E. reference electrode was measured after 1 hour application of an anodic current of 100 ma./cm$^2$. The electrodes all used titanium as the base metal, and each was sprayed with a solution of either $SnCl_4 .5H_2O$ or Ti(i-pro)$_4$ (or a mixture) containing also an antimony dopant and manganese catalyst as specified in Table III, and then baked at 475° C. for 0.5 hour. Electrodes M, N and O are additionally immersed in aqueous 0.01 M $RuCl_3$ for one minute, thoroughly washed with distilled water, and baked at 475° C. for 15 minutes according to the present invention. Electrodes P and Q are similar to electrodes prepared according to the Cook U.S. Pat. No. 3,882,002 by additionally spraying on $RuCl_3$ solution in n-butanol and baking at 475° C. for 15 minutes. Potentials of the various metal oxide electrodes after 1 hour application of 100 ma./cm$^2$ anodic current are given in Table III. Comparison of Electrodes M and N demonstrates the large improvement in chloride oxidation overpotential achieved by sequential exposures of the electrodes to $RuCl_3$ solution.

Tables I, II and III illustrate that electrodes prepared in accordance with the present invention have overpotentials which compare favorably with electrodes consisting of a titanium base and with a noble metal oxide outer layer. In each case, a lessened expenditure of noble metal is required to prepare the superficially mixed oxide electrode. X-ray photoelectron spectroscopy of Electrodes B, C, G, H, M, N and O, as prepared according to the present invention, shows peaks for rhodium, ruthenium and iridium, variously, and in addition show strong peaks for tin and titanium. Photoelectron peaks for tin and/or titanium are absent in the spectra of Electrodes D, E, I, J, P and Q.

TABLE III

| Electrode | Spray Solution Composition | Soaking Solution | E after 1 hour for applied current 100 ma./cm$^2$ |
|---|---|---|---|
| K | 1.65 gram $SnCl_4 . 5H_2O$, 0.023 $MnCl_2 . 2H_2O$, 0.033 gram $SbCl_3$ in 25 ml n-butanol | | 7.0 |
| L | 1.05 gram Ti(i-pro)$_4$, 0.032 gram $SbCl_3$, 0.042 gram $MnCl_2 . 2H_2O$ in 20 ml n-butanol | | 2.32 |
| M | same as K | $RuCl_3$ (repeated twice) | 2.10 |
| N | same as K | $RuCl_3$ (repeated ten times) | 1.30 |
| O | same as L | $RuCl_3$ (repeated ten times) | 1.40 |
| P | 1 M $SnCl_4$, 0.2 M $SbCl_3$, 0.2 M $MnCl_2 . 2H_2O$ in n-butanol; baking; then spray 0.02 M $RuCl_3$ in n-butanol, three times; baking | | 1.17 |
| Q | 0.5 M $SnCl_4$, 0.5 M Ti(i-pro)$_4$ in n-butanol; baking; then spray 0.1 M $RuCl_3$ in n-butanol; baking | | 1.25 |

The experiments above demonstrate that electrodes prepared according to the present invention are true superficial mixed oxide electrodes as opposed to electrodes with undiluted layers of noble metal oxide as in the Cook U.S. Pat. No. 3,882,002 electrode, and that the superficial mixed oxide electrode conserves the quantity of noble metal component while retaining a favorable catalytic property for the oxidation of chloride to chlorine. Inasmuch as catalysis of electrochemical reactions is determined by the composition of the surface of the electrode material employed for the reaction, the superficial mixed oxide electrode should find use in any electrochemical oxidation or reduction reaction which depends on the presence of a mixture of noble and valve metal oxides on the electrode surface.

Various modifications of the present invention may be made without departing from the spirit or scope thereof and it should be understood that the invention is intended to be limited only as defined in the appended claims.

What is claimed is:

1. Process for making a superficially mixed metal oxide electrode comprising the steps of:
   (a) coating a conductive base metal with an oxide of a film-forming metal to form a metal oxide electrode,
   (b) immersing said metal oxide electrode of step (a) in a suitable solvent solution of a coordinately reactive salt of a noble metal, said metal having the ability to form an electrically conducting oxide,
   (c) removing said metal/oxide electrode from said solvent solution of step (b) and washing said metal oxide electrode with distilled water or other suitable solvent, whereby any separate and distinct outer noble metal salt layer formed by said immersion has been removed, and
   (d) heating said metal oxide electrode to form a superficially mixed oxide electrode.

2. The process of claim 1 wherein steps (b), (c) and (d) are sequentially repeated a plurality of times.

3. The process of claim 1 wherein the conductive base metal is titanium.

4. The process of claim 2 wherein the conductive base metal is titanium.

5. The process of claim 3 wherein the titanium is coated in step (a) with an oxide selected from conductive tin oxide, titanium oxide, and mixtures thereof.

6. The process of claim 4 wherein the titanium is coated in step (a) with an oxide selected from conductive tin oxide, titanium oxide, and mixtures thereof.

7. The process of claim 5 wherein the coordinatively reactive salt of a metal is selected from ruthenium trichloride, iridium trichloride, platinum trichloride, rhodium trichloride and mixtures thereof.

8. The process of claim 6 wherein the coordinatively reactive salt of a metal is selected from ruthenium trichloride, iridium trichloride, platinum trichloride, rhodium trichloride, and mixtures thereof.

9. The process in accordance with claim 1 wherein the solvent solution of step (b) is an aqueous solution.

10. Process for making a superficially mixed metal oxide electrode comprising the steps of:
   (a) coating a titanium electrode with a conductive tin oxide,
   (b) immersing the coated titanium electrode of step (a) in an aqueous solution of ruthenium trichloride,
   (c) removing the immersed coated titanium electrode and washing said coated titanium electrode with distilled water, whereby any separate and distinct outer layer of ruthenium trichloride formed by said immersion has been removed, and (d) heating the washed coated titanium electrode to form a superficially mixed metal oxide electrode.

11. The process of claim 10 wherein the titanium electrode of step (a) is coated with a conductive titanium oxide.

12. The process of claim 10 or 11 wherein steps (b), (c) and (d) are sequentially repeated a plurality of times.

* * * * *